United States Patent [19]

Löffler

[11] 4,400,852

[45] Aug. 30, 1983

[54] DIRT SEPARATOR WITH A WEB-CARDING PLATE

[75] Inventor: Walter Löffler, Neubulach, Fed. Rep. of Germany

[73] Assignee: Hollingsworth GmbH, Fed. Rep. of Germany

[21] Appl. No.: 298,862

[22] Filed: Sep. 3, 1981

[30] Foreign Application Priority Data

Sep. 10, 1980 [DE] Fed. Rep. of Germany ..... 3034036

[51] Int. Cl.[3] ..... D01G 15/82

[52] U.S. Cl. ..... 19/106 R; 19/107

[58] Field of Search ..... 19/106 R, 107

[56] References Cited

U.S. PATENT DOCUMENTS 4,309,796 1/1982 Garrison et al. ..... 19/107 X 4,314,387 2/1982 Löffler ..... 19/107 X

FOREIGN PATENT DOCUMENTS 23597 2/1981 European Pat. Off. ..... 19/107

45-18051 6/1970 Japan ..... 19/107

*Primary Examiner*—Louis Rimrodt

*Attorney, Agent, or Firm*—Townsend and Townsend

[57] ABSTRACT

The dirt separator for carding machines is located upstream of the doffer cylinder and comprises a knife blade (16) as well as a foot portion or base plate that is provided with a toothed wire clothing (19), which is arranged with a clearance of about 0.25 mm from the main drum of the carding machine. The knife blade (16) is preceeded by a gap (27), which is in fluid flow communication with a suction duct (24).

5 Claims, 2 Drawing Figures

DIRT SEPARATOR WITH A WEB-CARDING PLATE

BACKGROUND OF THE INVENTION

The invention relates to a dirt separator for cards and combs, which is located immediately in front of the doffing cylinder and has a knife blade which is located to point against the direction of rotation of the main cylinder, at an adjustable distance from the latter, and at a peripheral distance from a plate lying in front of the knife blade and extending at a short radial distance from the main cylinder, said dirt separator also having a base face adjoining the knife blade in the direction of rotation of the main cylinder, and an extraction chamber bridging the gap between the plate and the knife blade.

A dirt separator of this type serves to remove the particles of dirt still remaining in the fibres after carding or combing. However, it has been found that the run of the fibres leaving the card or comb is apparently disturbed by a dirt separator of this type, since the parallel alignment of the fibres is not so extensive as it is in the processing of fibres on a card or comb which contains no dirt separator of this type.

BRIEF SUMMARY OF THE INVENTION

It is an object of the invention to improve a dirt separator of the aforementioned type such, that the fibres leaving the machine have a higher degree of parallel alignment.

The achievement of this object is to be seen in the fact that the base face adjoining the knife blade is covered with a sawtooth wire clothing. A sawtooth wire clothing of this type, also referred to below as a web-carding plate, contributes substantially to ensuring that fibre ribbon leaves the card or comb with practically parallel fibres. In the final analysis, the quality of the yarn is improved as a result.

The distance of the sawtooth wire clothing from the main cylinder is preferably adjustable. The optimum effect of the webcarding plate can thereby be achieved.

According to a particular embodiment, the sawtooth wire clothing consists of lengths of sawtooth wire lying parallel to one another and having an approximately symmetrical tooth shape.

The most favourable distance of the sawtooth clothing from the main cylinder is approximately 0.25 mm.

A construction which is easy to maintain is obtained if the sawtooth wire clothing constitutes an exchangeable constructional unit.

BRIEF DESCRIPTION OF THE DRAWING

The invention is described in more detail below in an exemplary embodiment with reference to diagrammatic drawings in which.

DETAILED DESCRIPTION OF A PREFERRED EMBODIMENT

Figure 1:
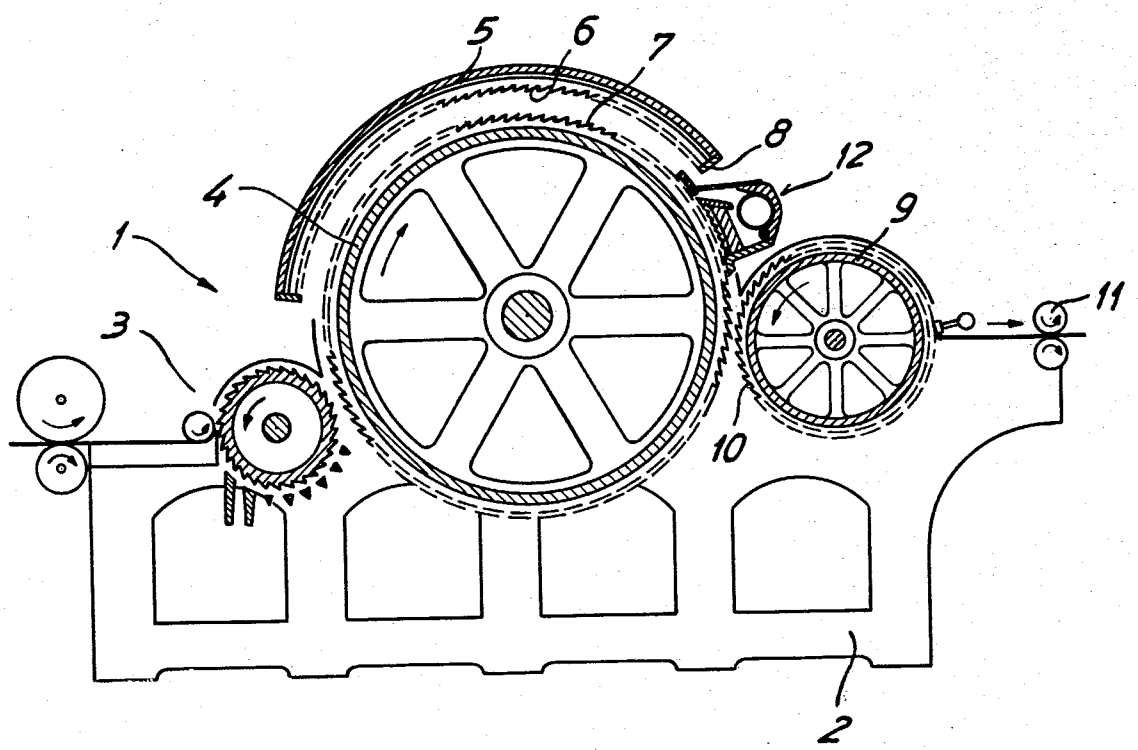
FIG. 1 shows a side view, represented partly in cross-section, of a card with a dirt separator.

The card 1 illustrated in FIG. 1 comprises a frame 2 on which the other constructional parts of the machine are fastened or mounted. The entry to the card is formed by a feed device 3 which comprises several rollers not shown in any more detail. Adjoining the feed device at a short distance is a main cylinder 4 which is covered over an upper region on its peripheral face with a cover plate 5 provided with a carding clothing 6 located at a short distance from the clothing 7 of the main cylinder.

Located at a peripheral distance from the rear end 8 of the cover plate 5 is a doffing cylinder 9 which is provided with a clothing 10 and which receives the fibre web from the main cylinder. The fibre web is taken off from the doffing cylinder 9 as a fibre ribbon by means of a pair of draw-off rollers 11 and thus leaves the card.

Figure 2:
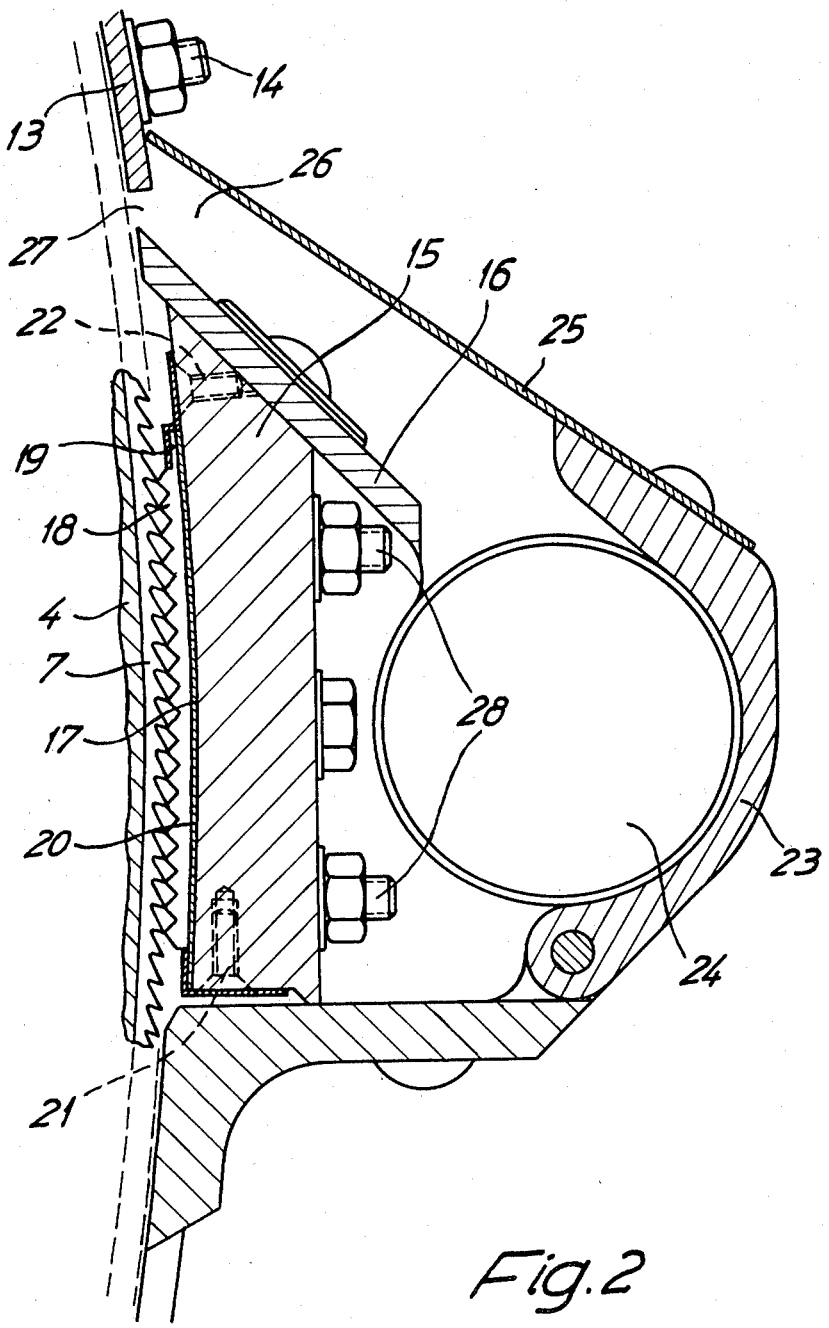
FIG. 2 shows a side view, represented partly in cross-section, of the dirt separator of FIG. 1.

Located in the free peripheral region between the rear end 8 of the cover plate 5 and the doffing cylinder 9 is a dirt separator 12, the construction of which can be seen in detail in FIG. 2.

A plate 13 is located at a parallel distance from the clothing 7 of the main cylinder 4. The distance can be adjusted by means of a setscrew 14 and is generally 0.25 to 1 mm.

Located behind the plate 13, looking in the direction of rotation of the main cylinder, is a sectional element 15 which is fastened to the frame 2 of the card and which extends over the entire width of the card. This sectional element is chamfered on the face lying at the front against the direction of rotation and carries there a knife blade 16, the distance of which from the clothing of the main cylinder is adjustable.

Screwed onto the base face 17 of the sectional element 15 is a web-carding plate 18 which consists of a number of lengths of sawtooth wire 19 which lie parallel to one another and which are fastened on a thin, slightly arched baseplate 20. The constructional unit of a web-carding plate, formed in this way, can be exchanged easily, since the baseplate 20, which projects just beyond the lengths of sawtooth wire 19, is fastened to the sectional element 15 by means of screws 21 and 22.

The housing part 23 is an integral part of the sectional element. The circular-cylindrical cavity 24 serves as an extraction chamber and is connected to a vacuum source.

Screwed to the unencumbered end of the housing part 23 is a masking sheet 25 which extends up to the cover-stripping plate 13 and which limits, together with the knife blade 16, an extraction channel 26 adjoining the gap 27 between the plate 13 and the knife blade 16.

The knife blade 16, the masking sheet 25 and the web-carding plate consisting of the lengths of sawtooth wire 19 and the baseplate 20 are all fastened to the sectional element, so that the dirt separator constitutes a single sub-assembly which can be exchanged easily. The distance of this sub-assembly and, consequently, also the distance of the web-carding plate from the main cylinder can be adjusted by means of screws 28. The plate 13 is also included as a functional part.

A dirt separator of this type does not disturb the parallel positioning of the fibres and can be attached subsequently to existing cards and combs, without relatively large refittings being necessary.

The advantageous effect is independent of the type and design of the card or comb on which the dirt separator is used.

It comes within the scope of the invention to use lengths of sawtooth wire having different tooth shapes and tooth sizes to match the fibres to be processed.

I claim:

1. An improved dirt separator, used with cards and combs of the type including a doffing cylinder and a main cylinder rotatable in a first rotational direction, the dirt separator of the type including a plate closely spaced apart a short radial distance from the main cylinder, a knife blade located to point against the direction of rotation of the main cylinder, at an adjustable distance from the latter, and at a peripheral distance behind the plate in the first rotational direction, a base face adjoining the knife blade in the first rotational direction, and an extraction chamber covering a gap between the plate and the knife blade, the improvement comprising: wherein the base face is covered with a sawtooth wire clothing; and means for mounting the dirt separator immediately in front of the doffing cylinder.

2. Dirt separator according to claim 1, further comprising means for adjusting the distance between the sawtooth wire clothing and the main cylinder.

3. Dirt separator according to claims 1 or 2, characterised in that the sawtooth wire clothing consists of lengths of sawtooth wire lying parallel to one another and having a symmetrical tooth shape.

4. Dirt separator according to claim 1 characterised in that the distance of the sawtooth wire clothing (19) from the main cylinder is approximately 0.25 mm.

5. Dirt separator according to claim 1 characterised in that the sawtooth wire clothing constitutes an exchangeable constructional unit.

* * * * *